US012674587B2

(12) United States Patent
Yashar

(10) Patent No.: US 12,674,587 B2
(45) Date of Patent: Jul. 7, 2026

(54) WATER TREATMENT SYSTEM AND TREATING WATER FOR ABATING BACTERIAL GROWTH

(71) Applicant: Government of the United States of America, as represented by the Secretary of Commerce, Gaithersburg, MD (US)

(72) Inventor: David Anthony Yashar, Dunn Loring, VA (US)

(73) Assignee: Government of the United States of America, as represented by Secretary of Commerce, Gaithersburg, MD (US)

( * ) Notice: Subject to any disclaimer, the term of this patent is extended or adjusted under 35 U.S.C. 154(b) by 505 days.

(21) Appl. No.: 18/101,624

(22) Filed: Jan. 26, 2023

(65) Prior Publication Data

US 2023/0167983 A1 Jun. 1, 2023

Related U.S. Application Data

(63) Continuation-in-part of application No. 17/146,330, filed on Jan. 11, 2021, now abandoned.

(60) Provisional application No. 62/958,877, filed on Jan. 9, 2020.

(51) Int. Cl.
*F24H 15/14* (2022.01)
*F24D 17/00* (2022.01)

(52) U.S. Cl.
CPC ..... *F24D 17/0073* (2013.01)

(58) Field of Classification Search
CPC ..... F24D 2220/06; F24H 1/10; F24H 15/184; F24H 1/12; F24H 1/52; F24H 1/526; F24H 9/146; F24H 7/02
See application file for complete search history.

(56) References Cited

U.S. PATENT DOCUMENTS 3,850,801 A 11/1974 Pearson
5,115,491 A * 5/1992 Perlman ..... F24D 17/00 137/340
5,588,088 A * 12/1996 Flaman ..... F24D 17/00 126/362.1
5,701,387 A * 12/1997 McGugan ..... F24D 17/0073 122/13.3
6,835,307 B2 * 12/2004 Talbert ..... F28D 20/0039 210/194
9,702,585 B2 7/2017 Hayden et al.
10,088,852 B2 * 10/2018 Hazzard ..... F24H 15/315
(Continued)

FOREIGN PATENT DOCUMENTS

DE 3525990 A1 1/1987
DE 19818630 C2 8/2003
(Continued)

*Primary Examiner* — Gregory A Wilson
(74) *Attorney, Agent, or Firm* — Office of Chief Counsel for National Institute of Standards and Technology

(57) ABSTRACT

A water treatment system treats water to abates bacterial growth and includes a fluid-isolated heat exchanger; a water treatment container that heats water to a high water temperature that is greater than or equal to a kill temperature for bacteria; a hot water delivery conduit including a transitional cooling zone in thermal communication with the fluid-isolated heat exchanger and that provides bacteria-free water from the water treatment container at a safe temperature.

8 Claims, 4 Drawing Sheets

(56) References Cited

U.S. PATENT DOCUMENTS

| | | | | |
|---|---|---|---|---|
| 2002/0050478 | A1* | 5/2002 | Talbert | F28D 7/106<br>210/931 |
| 2012/0266864 | A1 | 10/2012 | Wright | |

FOREIGN PATENT DOCUMENTS

| | | | | |
|---|---|---|---|---|
| EP | 1767881 | A1 | 3/2007 | |
| GB | 2506582 | A | 9/2014 | |
| WO | 02075219 | A1 | 9/2002 | |
| WO | WO-2018091914 | A1 * | 5/2018 | C02F 1/008 |
| WO | 2019014711 | A1 | 1/2019 | |

* cited by examiner

WATER TREATMENT SYSTEM AND TREATING WATER FOR ABATING BACTERIAL GROWTH

CROSS REFERENCE TO RELATED APPLICATIONS

This application is a continuation-in-part and claims benefit of U.S. patent application Ser. No. 17/146,330 (filed Jan. 11, 2021), which claims priority to U.S. Provisional Patent Application Ser. No. 62/958,877 (filed Jan. 9, 2020), each of which is incorporated herein by reference in its entirety.

STATEMENT REGARDING FEDERALLY SPONSORED RESEARCH

This invention was made with United States Government support from the National Institute of Standards and Technology (NIST), an agency of the United States Department of Commerce. The Government has certain rights in the invention.

BRIEF DESCRIPTION

Disclosed is a water treatment system for treating water to abate bacterial growth and comprising: an optional cold water supply conduit that receives input cold water and communicates the input cold water to a water treatment container; the water treatment container in thermal communication with a heater and that: receives the input cold water at cold water temperature TC, receives main heat from the heater, increases cold water temperature TC of the input cold water by the main heat from the heater, produces container heated water at high water temperature TH from the input cold water by increasing cold water temperature TC to high water temperature TH, and communicates the container heated water, such that high water temperature TH is greater than or equal to kill temperature TK for bacteria to kill bacteria in the container heated water, and such that the container heated water does not contain viable bacteria; a hot water delivery conduit comprising a transitional cooling zone and a delivery zone in fluid communication with the transitional cooling zone, such that the transitional cooling zone is arranged along the hot water delivery conduit; the transitional cooling zone in thermal communication with a fluid-isolated heat exchanger, such that the transitional cooling zone: receives the container heated water from the water treatment container, communicates second heat from the container heated water to the fluid-isolated heat exchanger in an absence of communicating the container heated water to the fluid-isolated heat exchanger and in an absence of receiving input cold water, decreases high water temperature TH of the container heated water by transfer of second heat from the container heated water to the fluid-isolated heat exchanger in an absence of fluid communication between the hot water delivery conduit and the fluid-isolated heat exchanger, produces transitionally cooled water at hot water delivery temperature TD from the container heated water by decreasing high water temperature TH to hot water delivery temperature TD, and communicates the transitionally cooled water as delivery hot water to the delivery zone; and the fluid-isolated heat exchanger in thermal communication with the transitional cooling zone and that: provides heat flow from the transitional cooling zone while maintaining fluid isolation between the transitional cooling zone and the cold water conduit, such that the transitional cooling zone does not contain viable bacteria from the water treatment container or the cold water supply conduit, wherein the fluid-isolated heat exchanger contacts the transitional cooling zone of the hot water delivery conduit in absence of contact with the cold water supply conduit.

Disclosed is a water treatment system for treating water for abating bacterial growth, the water treatment system comprising: a cold water supply conduit; a transitional heating zone within the cold water supply conduit; a water treatment container in fluid communication with the transitional heating zone and in thermal communication with a heater that receives the transitionally heated water from the transitional heating zone and produces container heated water by increasing temperature of the transitionally heated water to high water temperature TH such that the high water temperature is greater than or equal to a kill temperature TK for bacteria; a hot water delivery conduit; a transitional cooling zone within the hot water delivery conduit; a fluid-isolated heat exchanger in thermal communication with the transitional heating zone and the transitional cooling zone and that provides heat flow from the transitional cooling zone to the transitional heating zone while maintaining fluid isolation between the transitional heating zone and the transitional cooling zone, such that transitional cooling zone does not contain viable bacteria from the water treatment container.

Disclosed is a process for treating water for abating bacterial growth, the process comprising: receiving, by a water treatment container, water at a first water temperature; receiving, by the water treatment container, main heat from a heater; increasing, in the water treatment container, the cold water by the main heat from the heater; producing, in the water treatment container, the container heated water at a high water temperature TH from the cold water by increasing a temperature of the cold water from the first water temperature to the high water temperature TH; communicating the container heated water from the water treatment container to a transitional cooling zone, such that the high water temperature TH is greater than or equal to the kill temperature TK for bacteria to kill bacteria in the container heated water, and the container heated water does not contain viable bacteria; receiving, by the transitional cooling zone, the container heated water from the water treatment container; communicating the second heat from the container heated water in the transitional cooling zone to the fluid-isolated heat exchanger; decreasing, in the transitional cooling zone, the high water temperature TH of the container heated water by transferring second heat from the container heated water to the fluid-isolated heat exchanger; producing, in the transitional cooling zone, transitionally cooled water at a hot water delivery temperature TD from the container heated water by decreasing from the high water temperature TH to a hot water delivery temperature TD; and providing, by the fluid-isolated heat exchanger, heat flow from the transitional cooling zone while maintaining fluid isolation between the transitional cooling zone and a supply of the cold water, such that transitional cooling zone does not contain viable bacteria from water treatment container, to abate bacterial growth.

BRIEF DESCRIPTION OF THE DRAWINGS

The following description should not be considered limiting in any way. With reference to the accompanying drawings, like elements are numbered alike.

DETAILED DESCRIPTION

A detailed description of one or more embodiments is presented herein by way of exemplification and not limitation.

It has been discovered that water treatment system 200 and treating water for abating bacterial growth provide an unmixed, liquid-to-liquid heat exchanger to transfer thermal energy between water entering and exiting a storage tank. In so disposing such heat exchanger, the water heater operates at a much higher temperature than permitted in conventional applications, and this increases effectiveness for pathogen control. Water treatment system 200 and treating water for abating bacterial growth cools water leaving the water heater to a temperature safe for distribution within a plumbing network by recovering thermal energy from hot water from the water heater and simultaneously satisfies goals of water quality, energy efficiency, and safety from scalding while abating bacteria growth and killing bacteria in the cold water supplied to the water treatment system 200.

*Legionella pneumophila* is an opportunistic pathogen in premise plumbing systems (OPPPs) that is responsible for Legionnaires' Disease, which is a form of pneumonia with a 10% mortality rate. *Legionella pneumophila* can be present in water sources used throughout the world. Under certain circumstances *Legionella pneumophila* can thrive in premise plumbing systems and multiply into colonies that can infect humans. Designing and operating components of premise plumbing systems can reduce risk of exposing people to these pathogens. Reducing pathogens in a plumbing system can be achieved by elevating the water temperature. Water that is too hot can result in severe injuries from scalding and also can waste energy. There is a need for an appropriate thermal process to balance objectives of effectiveness, safety, or energy that is satisfied by the water treatment system 200 and treating water for abating bacterial growth described herein.

Figure 1:
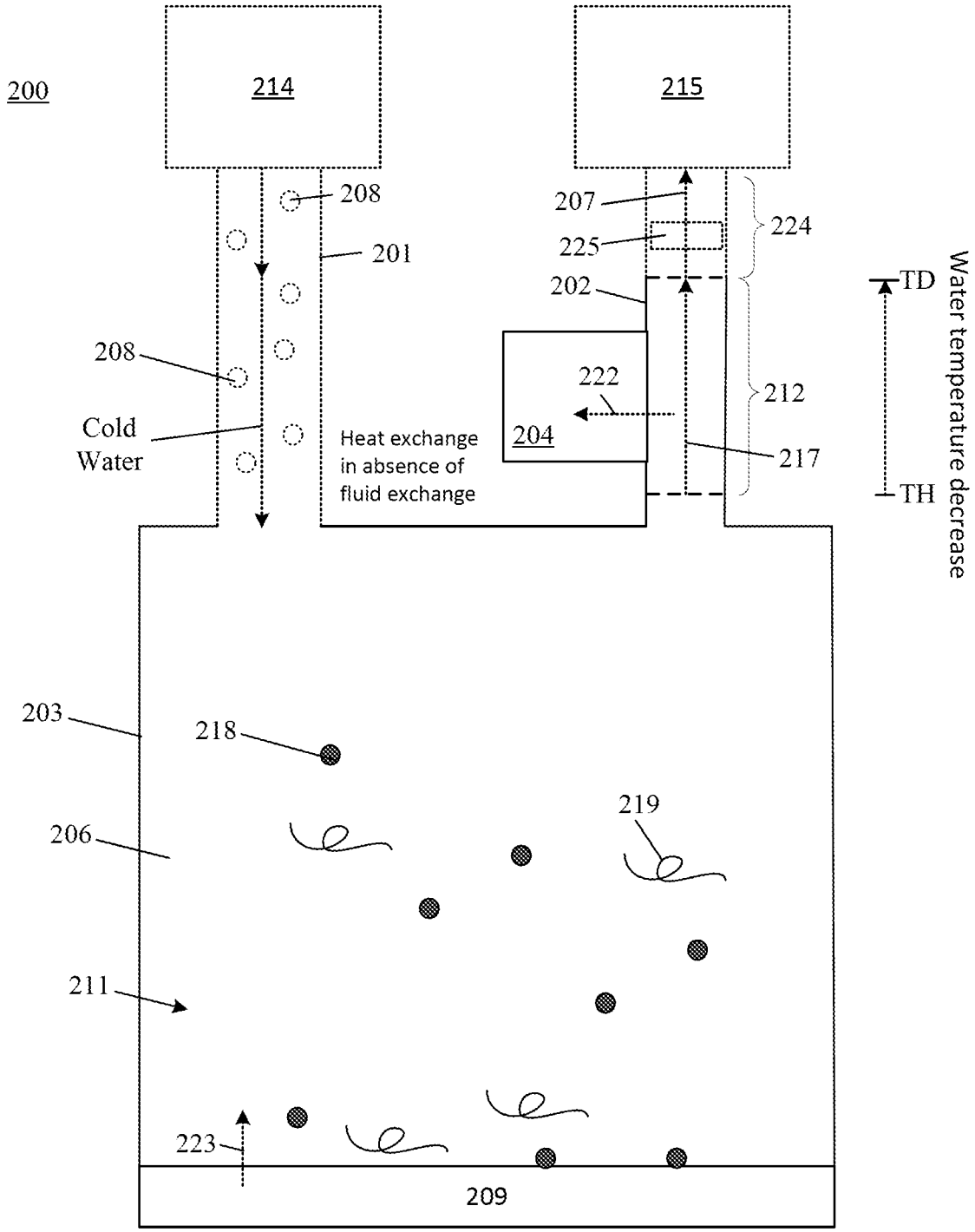
FIG. 1 shows a water treatment system.

In an embodiment, with reference to FIG. 1, water treatment system 200 treats water to abate bacterial growth and includes: optional cold water supply conduit 201 that receives input cold water 205 and communicates input cold water 205 to water treatment container 203; water treatment container 203 in thermal communication with heater 209 and that: receives input cold water 205 at cold water temperature TC, receives main heat 223 from heater 209, increases cold water temperature TC of input cold water 205 by main heat 223 from heater 209, produces container heated water 206 at high water temperature TH from input cold water 205 by increasing cold water temperature TC to high water temperature TH, and communicates container heated water 206, such that high water temperature TH is greater than or equal to kill temperature TK for bacteria to kill bacteria in container heated water 206, and such that container heated water 206 does not contain viable bacteria 208; hot water delivery conduit 202 including transitional cooling zone 212 and delivery zone 224 in fluid communication with transitional cooling zone 212, such that transitional cooling zone 212 is arranged along hot water delivery conduit 202; transitional cooling zone 212 in thermal communication with fluid-isolated heat exchanger 204, such that transitional cooling zone 212: receives container heated water 206 from water treatment container 203, communicates second heat 222 from container heated water 206 to fluid-isolated heat exchanger 204 in an absence of communicating container heated water 206 to fluid-isolated heat exchanger and in an absence of receiving input cold water 205, decreases high water temperature TH of container heated water 206 by transfer of second heat 222 from container heated water 206 to fluid-isolated heat exchanger 204 in an absence of fluid communication between hot water delivery conduit 202 and fluid-isolated heat exchanger 204, produces transitionally cooled water 217 at hot water delivery temperature TD from container heated water 206 by decreasing high water temperature TH to hot water delivery temperature TD, and communicates transitionally cooled water 217 as delivery hot water 207 to delivery zone 224; and fluid-isolated heat exchanger 204 in thermal communication with transitional cooling zone 212 and that: provides heat flow 222 from transitional cooling zone 212 while maintaining fluid isolation between transitional cooling zone 212 and cold water supply conduit 201, such that transitional cooling zone 212 does not contain viable bacteria 208 from water treatment container 203 or cold water supply conduit 201, wherein fluid-isolated heat exchanger 204 contacts transitional cooling zone 212 of hot water delivery conduit 202 in absence of contact with cold water supply conduit 201.

Water treatment system 200 treats water and abates bacteria growth. In an embodiment, water treatment system 200 includes: optional cold water supply conduit 201 that receives input cold water 205 and communicates input cold water 205 to water treatment container 203; water treatment container 203 in thermal communication with heater 209 and that receives input cold water 205 at cold water temperature TC, receives main heat 223 from heater 209, and increases cold water temperature TC of input cold water 205 by main heat 223 from heater 209, and produces container heated water 206 at high water temperature TH from input cold water 205 by increasing cold water temperature TC to high water temperature TH and communicates container heated water 206, such that high water temperature TH is greater than or equal to kill temperature TK for bacteria to kill bacteria in container heated water 206, such that container heated water 206 does not contain viable bacteria 208; hot water delivery conduit 202 in thermal communication with fluid-isolated heat exchanger 204, such that transitional cooling zone 212 receives container heated water 206 from water treatment container 203, communicates second heat 222 from container heated water 206 to fluid-isolated heat exchanger 204, decreases high water temperature TH of container heated water 206 by transfer of second heat 222 from container heated water 206 to fluid-isolated heat exchanger 204, produces transitionally cooled water 217 at hot water delivery temperature TD from container heated water 206 by decreasing temperature from high water temperature TH to hot water delivery temperature TD, and communicates transitional cooling zone 212 as delivery hot water 207; and fluid-isolated heat exchanger 204 in thermal communication with transitional cooling zone 212 and that provides heat flow 216 from transitional cooling zone 212 while maintaining fluid isolation between transitional cooling zone 212 and cold water supply conduit 201, such that transitional cooling zone 212 does not contain viable bacteria 208 from water treatment container 203.

Figure 2:
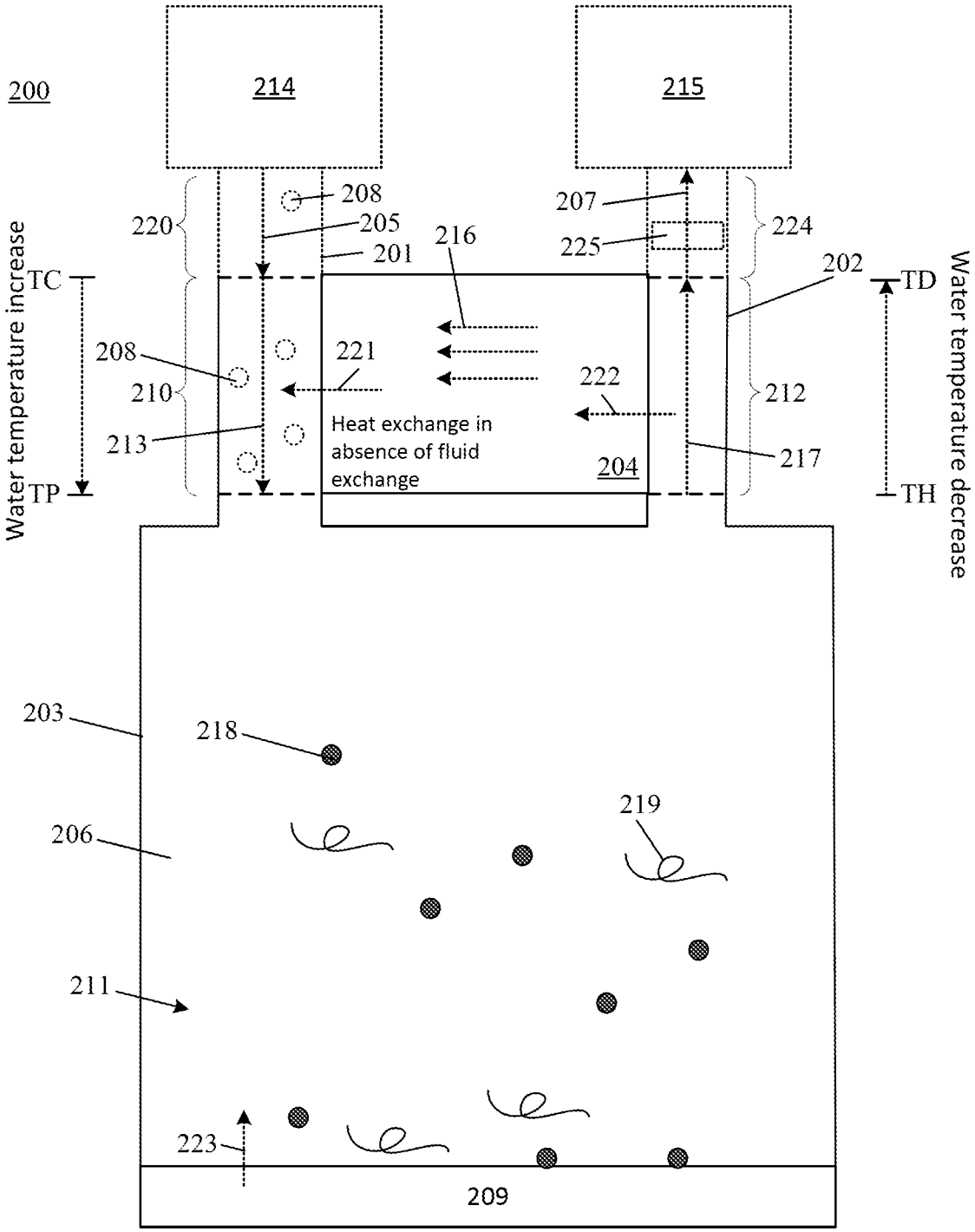
FIG. 2 shows a water treatment system.
Figure 3:
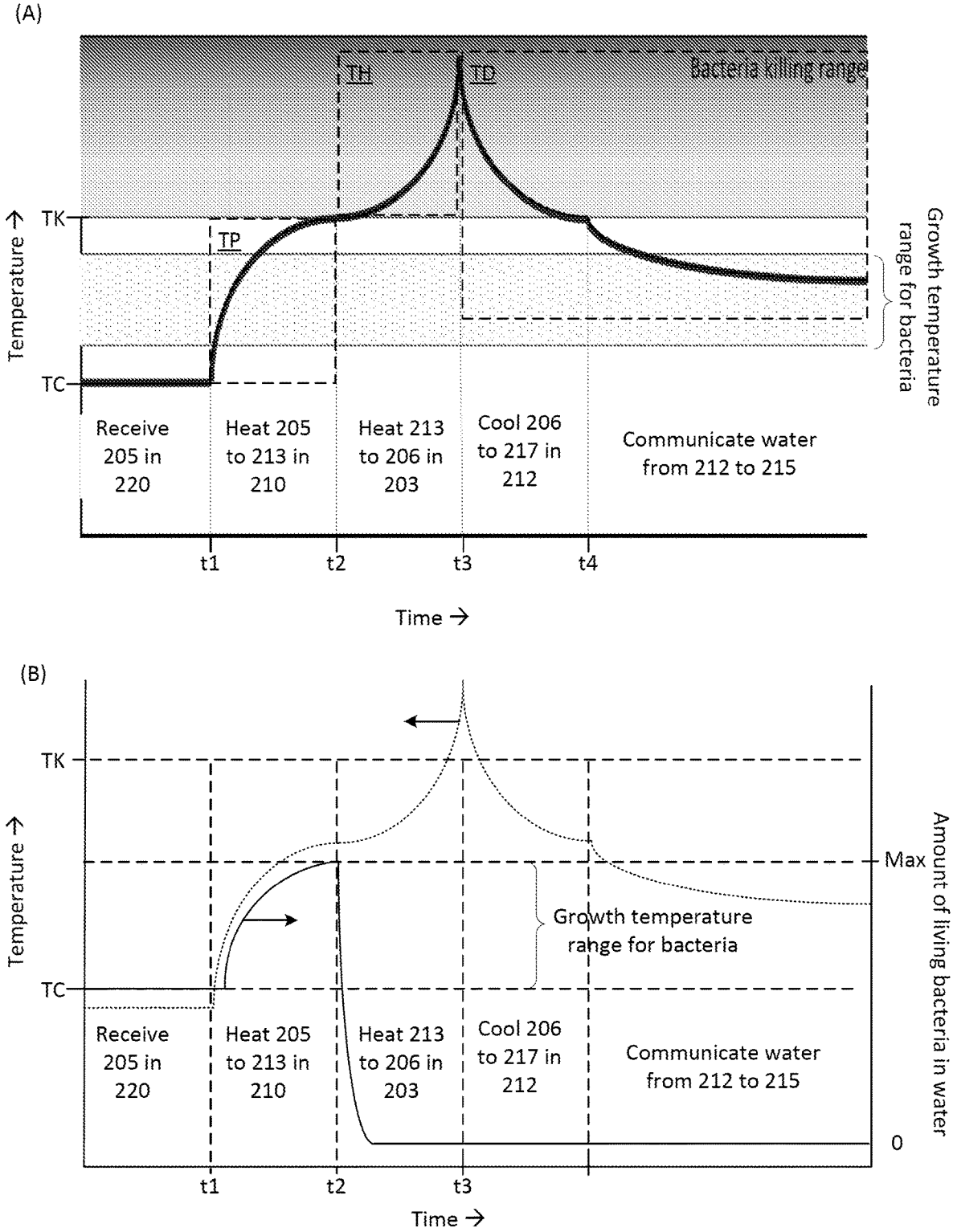
FIG. 3 shows a graph of temperature versus time in panel A and a graph of temperature and amount of live bacteria in water versus time in panel B.
Figure 4:
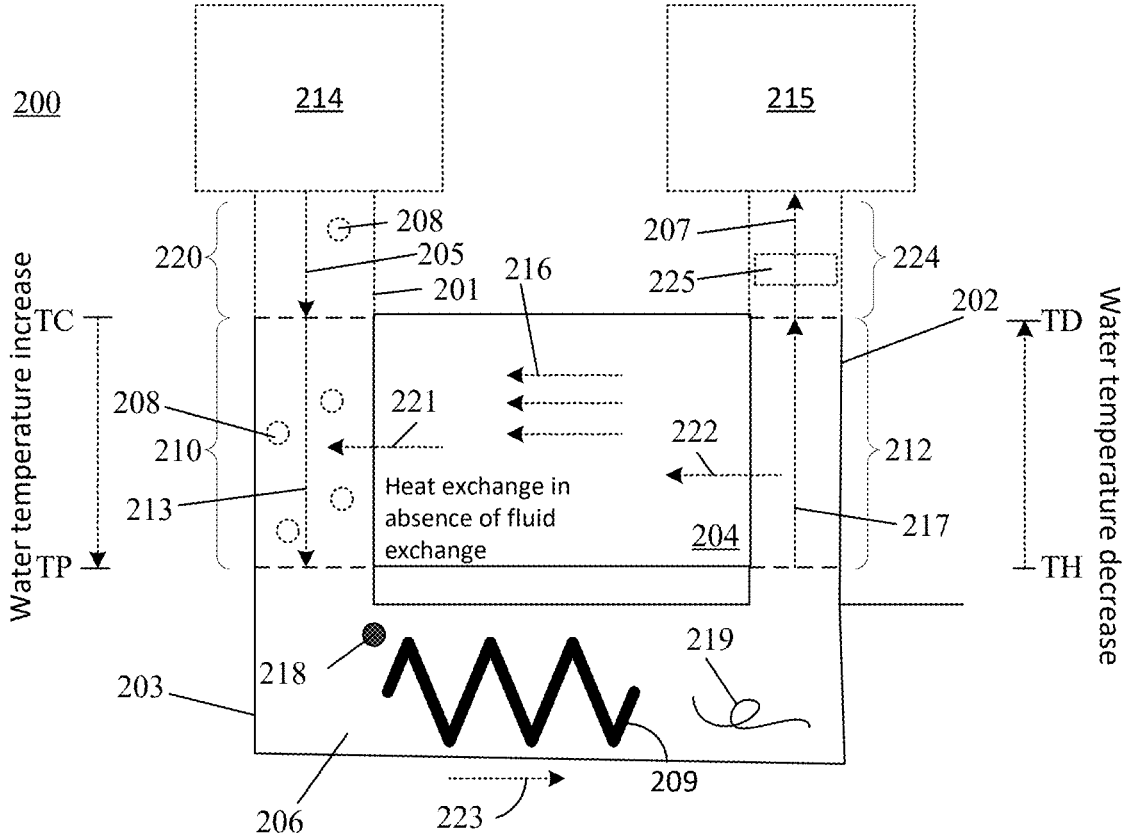
FIG. 4 shows an alternative embodiment of the water treatment system of FIG. 2, wherein the water treatment container is a tankless water heater.

In an embodiment, with reference to FIG. 2 and FIG. 3, water treatment system 200 includes: cold water supply conduit 201 including transitional heating zone 210 that receives input cold water 205 and communicates input cold water 205; transitional heating zone 210 arranged along cold water supply conduit 201 interposed between supply zone 220 and water treatment container 203 and in thermal communication with fluid-isolated heat exchanger 204, such that transitional heating zone 210 receives input cold water 205 from supply zone 220, receives first heat 221 from fluid-isolated heat exchanger 204, increases cold water temperature TC of input cold water 205 by first heat 221 from fluid-isolated heat exchanger 204, and produces transitionally heated water 213 at pre-heated water temperature TP from input cold water 205 by increasing temperature from cold water temperature TC to pre-heated water temperature TP, and communicates transitionally heated water 213; water treatment container 203 in fluid communication with transitional heating zone 210 and in thermal communication with heater 209 and that receives transitionally heated water 213 at cold water temperature TC from transitional heating zone 210, receives main heat 223 from heater 209, and increases pre-heated water temperature TP of transitionally heated water 213 by main heat 223 from heater 209, and produces container heated water 206 at high water temperature TH from transitionally heated water 213 by increasing temperature from pre-heated water temperature TP to high water temperature TH and communicates container heated water 206, such that high water temperature TH is greater than or equal to kill temperature TK for bacteria to kill bacteria in container heated water 206, such that container heated water 206 does not contain viable bacteria 208; hot water delivery conduit 202 including arranged along hot water delivery conduit 202 in thermal communication with fluid-isolated heat exchanger 204, such that transitional cooling zone 212 receives container heated water 206 from water treatment container 203, communicates second heat 222 from container heated water 206 to fluid-isolated heat exchanger 204, decreases high water temperature TH of container heated water 206 by transfer of second heat 222 from container heated water 206 to fluid-isolated heat exchanger 204, produces transitionally cooled water 217 at hot water delivery temperature TD from container heated water 206 by decreasing temperature from high water temperature TH to hot water delivery temperature TD, and communicates transitional cooling zone 212 as delivery hot water 207; and fluid-isolated heat exchanger 204 in thermal communication with transitional heating zone 210 and transitional cooling zone 212 and that provides heat flow 216 from transitional cooling zone 212 to transitional heating zone 210 while maintaining fluid isolation between transitional heating zone 210 and transitional cooling zone 212, such that transitional cooling zone 212 does not contain viable bacteria 208 from water treatment container 203.

Water treatment system 200 abates bacteria growth. In an embodiment, with reference to FIG. 2 and FIG. 3, water treatment system 200 includes: cold water supply conduit 201 including supply zone 220 and transitional heating zone 210 in fluid communication with supply zone 220 such that supply zone 220 receives input cold water 205 and communicates input cold water 205; transitional heating zone 210 arranged along cold water supply conduit 201 interposed between supply zone 220 and water treatment container 203 and in thermal communication with fluid-isolated heat exchanger 204, such that transitional heating zone 210 receives input cold water 205 from supply zone 220, receives first heat 221 from fluid-isolated heat exchanger 204, increases cold water temperature TC of input cold water 205 by first heat 221 from fluid-isolated heat exchanger 204, and produces transitionally heated water 213 at pre-heated water temperature TP from input cold water 205 by increasing temperature from cold water temperature TC to pre-heated water temperature TP, and communicates transitionally heated water 213; water treatment container 203 in fluid communication with transitional heating zone 210 and in thermal communication with heater 209 and that receives transitionally heated water 213 at pre-heated water temperature TP from transitional heating zone 210, receives main heat 223 from heater 209, and increases pre-heated water temperature TP of transitionally heated water 213 by main heat 223 from heater 209, and produces container heated water 206 at high water temperature TH from transitionally heated water 213 by increasing temperature from pre-heated water temperature TP to high water temperature TH and communicates container heated water 206, such that high water temperature TH is greater than or equal to kill temperature TK for bacteria to kill bacteria in container heated water 206, such that container heated water 206 does not contain viable bacteria 208; hot water delivery conduit 202 including transitional cooling zone 212 and delivery zone 224 in fluid communication with transitional cooling zone 212; transitional cooling zone 212 arranged along hot water delivery conduit 202 interposed between water treatment container 203 and delivery zone 224 and in thermal communication with fluid-isolated heat exchanger 204, such that transitional cooling zone 212 receives container heated water 206 from water treatment container 203, communicates second heat 222 from container heated water 206 to fluid-isolated heat exchanger 204, decreases high water temperature TH of container heated water 206 by transfer of second heat 222 from container heated water 206 to fluid-isolated heat exchanger 204, and produces transitionally cooled water 217 at hot water delivery temperature TD from container heated water 206 by decreasing temperature from high water temperature TH to hot water delivery temperature TD, and communicates transitionally cooled water 217 to delivery zone 224; delivery zone 224 in fluid communication with transitional cooling zone 212 and that receives transitionally cooled water 217 from transitional cooling zone 212 and communicates transitional cooling zone 212 as delivery hot water 207; and fluid-isolated heat exchanger 204 in thermal communication with transitional heating zone 210 and transitional cooling zone 212 and that provides heat flow 216 from transitional cooling zone 212 to transitional heating zone 210 while maintaining fluid isolation between transitional heating zone 210 and transitional cooling zone 212, such that transitional cooling zone 212 does not contain viable bacteria 208 from water treatment container 203.

Components of water treatment system 200 can be made from and include various materials. Cold water supply conduit 201 provides input cold water 205 for heating by first heat 221 in transitional heating zone 210 and main heat 223 in water treatment container 203. Cold water supply conduit 201 can include various elements so that input cold water 205 and transitionally heated water 213 flow therethrough. A flow rate through cold water supply conduit 201 can be controlled, actively or statically, or uncontrolled. To effect flow control, a flow controller, regulator, or arrestor can be used. The flow rate can be limited or free to change based on an amount of water supplied by cold water source 214. Valves can and indicators (e.g., a thermocouple or the like) can be connected to cold water supply conduit 201.

Input cold water 205 can include viable bacteria 208 that, under certain thermal conditions such as a growth temperature TG, e.g., 20° C.<TG<45° C., are viable and can reproduce to form additional bacteria. Such bacteria are rendered to be unviable bacteria 218 or unviable bacterial component 219 by main heat 223 in water treatment container 203 so that container heated water 206 is free of live bacteria when delivered to transitional cooling zone 212 and cooled to become transitionally cooled water 217. A temperature of input cold water 205 is cold water temperature TC.

Viable bacteria 208 can include pathogenic or non-pathogenic bacteria of any sort, such as rods or cocci. Exemplary pathogenic bacteria include *Legionella pneumophila*.

Transitional heating zone 210 receives input cold water 205 from supply zone 220 and is heated by first heat 221 from fluid-isolated heat exchanger 204 to heat input cold water 205 to transitionally heated water 213 by increasing cold water temperature TC to pre-heated water temperature TP of transitionally heated water 213.

Water treatment container 203 receives transitionally heated water 213 from transitional heating zone 210 and is heated by main heat 223 from heater 209 to heat transitionally heated water 213 to container heated water 206 by increasing pre-heated water temperature TP to high water temperature TH of container heated water 206. It is contemplated that viable bacteria 208 cannot grow, remain viable, or remain intact as bacteria at high water temperature TH. That is, viable bacteria 208 are killed in water treatment container 203 by container heated water 206 acquiring high water temperature TH by application of main heat 223 to transitionally heated water 213. Although viable bacteria 208 from input cold water 205 can be converted to unviable bacteria 218 in water treatment container 203, due to high water temperature TH, such is reliably converted to unviable bacterial component 219 such as free-floating cell wall, amino acids, proteins, nucleic acid material, atoms, cellular components, cellular fluids, and the like from lysing or otherwise destroying the cell wall of input cold water 205. A temperature of container heated water 206 is high water temperature TH. It should be appreciated that high water temperature TH is greater than or equal to kill temperature TK of bacteria. Kill temperature TK is a minimum temperature for killing bacteria and depends on a genus or species of an arbitrary bacterium. Accordingly, high water temperature TH can be selectively tailored for targeted killing of viable bacteria 208 found in input cold water 205, which can vary from different cold water sources 214 that can differ by geographic locale. Exemplary water heaters include electric and gas water heaters.

It is contemplated that water treatment system 200 is a fixed volume system filled with an incompressible fluid, wherein fluid flow occurs only when fluid flows through the system. It should be appreciated that if water flows through both sides of the heat exchanger, there will be heat transfer, outgoing water would be cooled.

Water treatment container 203 can be an electric or gas water heater with a storage tank for storing heated water. However, it should be appreciated that other suitable water heating appliance can be used while remaining within the scope of the present subject matter. For example, tankless water heaters, hybrid heat pump water heaters, and solar water heaters can be used instead of a storage tank water heater. Indeed, water treatment system 200 can be applied for controlling any water supply 214 that is providing a supply of input cold water 205 to a water consuming sink such as user 215. Water treatment container 203 can include a casing. Inside the casing, water treatment container 203 can include a storage tank configured for storing water. Heater 209 can include heating elements that are positioned inside or around the storage tank for heating water (e.g., 213, 206) stored therein. Heating elements can include a gas burner, a heat pump, an electric resistance element, a microwave element, an induction element, a sealed heat pump system or any other suitable heating element or combination thereof.

Rendered free of live bacteria in water treatment container 203, container heated water 206 is communicated to transitional cooling zone 212 of hot water delivery conduit 202. Transitional heating zone 210 receives container heated water 206 from water treatment container 203 and is cooled by transferring second heat 222 from container heated water 206 to fluid-isolated heat exchanger 204 to cool container heated water 206 to transitionally cooled water 217 in transitional cooling zone 212 by decreasing high water temperature TH to hot water delivery temperature TD of transitionally cooled water 217. It is contemplated that viable bacteria 208 from input cold water 205 are not present in transitionally cooled water 217 in transitional cooling zone 212 at hot water delivery temperature TD.

Hot water delivery conduit 202 receives container heated water 206 and provides delivery hot water 207. Hot water delivery conduit 202 can include various elements so that transitionally cooled water 217 and delivery hot water 207 flow therethrough. A flow rate through hot water delivery conduit 202 can be controlled, actively or statically, or uncontrolled. To effect flow control, a flow controller, regulator, or arrestor can be used. The flow rate can be limited or free to change based on an amount of water supplied by container heated water 206. Valves can and indicators (e.g., a thermocouple or the like) can be connected to hot water delivery conduit 202. As shown in FIG. 2, flow controller 225 optionally can be in fluid communication with transitional cooling zone 212 and prevent delivery hot water 207 from flowing unless a temperature of delivery hot water 207 is less than or equal to safe delivery temperature TS. Safe delivery temperature TS is minimum temperature under which thermal damage to human tissue occurs. Damage includes scalding and the like and depends on a period of exposure of water at a certain temperature, wherein a burn injury can occur within 15 seconds for water at 56° C.

Fluid-isolated heat exchanger 204 exchanges heat with water in cold water supply conduit 201 and hot water delivery conduit 202 in an absence of fluid exchange between cold water supply conduit 201 and hot water delivery conduit 202. As used herein, "heat exchanger" refers to a device that transfers heat between one members such as cold water supply conduit 201 and hot water delivery conduit 202. Exemplary heat exchangers include shell and tube heat exchangers, plate heat exchangers, plate and shell heat exchangers, adiabatic wheel heat exchangers, plate fin heat exchangers, pillow plate heat exchangers, pipe coil heat exchangers, fluid heat exchangers, waste heat recovery units, dynamic scraped surface heat exchangers, phase-change heat exchangers, direct contact heat exchangers, and microchannel heat exchangers.

Water treatment system 200 can be made in various ways. It should be appreciated that water treatment system 200 can include a number of optical, electrical, or mechanical components, wherein such components can be interconnected and placed in communication (e.g., optical communication, electrical communication, fluid communication, mechanical communication, and the like) by physical, chemical, optical, or free-space interconnects. The components can be disposed on mounts that can be disposed on a bulkhead for alignment or physical compartmentalization. As a result, water treatment system 200 can be disposed in a terrestrial environment or space environment.

In an embodiment, a process for making water treatment system 200 includes: connecting cold water supply conduit 201 to water treatment container 203 in fluid communication; connecting water treatment container 203 to hot water delivery conduit 202 in fluid communication; thermally connecting cold water supply conduit 201 to hot water delivery conduit 202 via thermal interdisposition of fluid-isolated heat exchanger 204 between cold water supply conduit 201 and hot water delivery conduit 202, so that cold water supply conduit 201 is in thermal exchange communication with fluid-isolated heat exchanger 204, and cold water supply conduit 201 is in thermal exchange communication with fluid-isolated heat exchanger 204.

Water treatment system 200 has numerous advantageous and unexpected benefits and uses. In an embodiment, a process for treating water for abating bacterial growth with water treatment system 200 includes: receiving, by a water treatment container, water at a first water temperature; receiving, by the water treatment container, main heat from a heater; increasing, in the water treatment container, the cold water by the main heat from the heater; producing, in the water treatment container, the container heated water at a high water temperature TH from the cold water by increasing a temperature of the cold water from the first water temperature to the high water temperature TH; communicating the container heated water from the water treatment container to a transitional cooling zone, such that the high water temperature TH is greater than or equal to the kill temperature TK for bacteria to kill bacteria in the container heated water, and the container heated water does not contain viable bacteria; receiving, by the transitional cooling zone, the container heated water from the water treatment container; communicating the second heat from the container heated water in the transitional cooling zone to the fluid-isolated heat exchanger; decreasing, in the transitional cooling zone, the high water temperature TH of the container heated water by transferring second heat from the container heated water to the fluid-isolated heat exchanger; producing, in the transitional cooling zone, transitionally cooled water at a hot water delivery temperature TD from the container heated water by decreasing from the high water temperature TH to a hot water delivery temperature TD; and providing, by the fluid-isolated heat exchanger, heat flow from the transitional cooling zone while maintaining fluid isolation between the transitional cooling zone and a supply of the cold water, such that transitional cooling zone does not contain viable bacteria from water treatment container, to abate bacterial growth.

In an embodiment, the first water temperature is the cold water temperature TC. In certain embodiments, the cold water is transitionally heated water, and the first water temperature is a pre-heated water temperature TP of the transitionally heater water, such that receiving, by the water treatment container, water at the first water temperature comprises receiving, by the water treatment container, the transitionally heated water at the pre-heated water temperature TP from the transitional heating zone, and the process further includes: receiving, by a transitional heating zone, input cold water; receiving, by a transitional heating zone, first heat from the fluid-isolated heat exchanger via heat exchange; increasing, in the transitional heating zone, a cold water temperature TC of the input cold water by the first heat from the fluid-isolated heat exchanger; producing, in the transitional heating zone, transitionally heated water at a pre-heated water temperature TP from the input cold water by increasing temperature from the cold water temperature TC to the pre-heated water temperature TP; and communicating the transitionally heated water from the transitional heating zone to the water treatment container.

In an embodiment, treating water for abating bacterial growth includes providing, by the fluid-isolated heat exchanger, heat flow from the transitional cooling zone to the transitional heating zone while maintaining fluid isolation between the transitional heating zone and the transitional cooling zone, such that transitional cooling zone does not contain viable bacteria from water treatment container, to abate bacterial growth.

In an embodiment, treating water for abating bacterial growth includes receiving the input cold water by a supply zone of the cold water supply conduit, wherein the transitional heating zone is in fluid communication with the supply zone such that the supply zone receives input cold water and communicates the input cold water to the transitional heating zone.

In an embodiment of treating water for abating bacterial growth, the transitional heating zone receives the input cold water from the supply zone.

In an embodiment, treating water for abating bacterial growth includes communicating the transitionally cooled water to a delivery zone from the transitional cooling zone.

In an embodiment, treating water for abating bacterial growth includes receiving, by the delivery zone, the transitionally cooled water from the transitional cooling zone; and communicating the transitional cooling zone as delivery hot water from the delivery zone.

In an embodiment, treating water for abating bacterial growth includes preventing the delivery hot water 207 from flowing unless a temperature of the delivery hot water 207 is less than a safe delivery temperature TS.

It should be appreciated that container heated water 206 and delivery hot water 207 can be used for commercial and domestic hot water use applications at temperatures less likely to cause injury.

Advantageously, water treatment system 200 overcomes limitations of technical deficiencies of conventional compositions. *Legionella* was identified as the cause of Legionnaires disease. Conventional approaches to limit risk of exposure to *Legionella* have limitations, and none eliminate exposure. Conventional technologies include thermal management, wherein building plumbing prevents stagnant water in piping at temperatures for bacteria growth. The conventional technologies can be complex to operate or install, expensive, or require human interaction or oversight. Moreover, conventional systems can be subject to heat shock during periods when extremely hot water flows through the system to decontaminate the piping from contamination. This conventional process is a reactionary approach and can be dangerous to building occupants, increasing the temperature of hot water in a building that helps to support thermal management approaches and is not permitted by most plumbing codes. Addition of chemical disinfectants (e.g., chlorine, chlorine dioxide, monochloramine, and ozone, to water is a conventional approach implemented by water treatment facilities, the addition is challenging to dose because predicting dosing involves knowledge of water usage in municipal systems and buildings where the water is distributed such that this is limited and limits effectiveness. Moreover, ultraviolet radiation is used conventionally to kill *Legionella* in water systems, but systems that employ these means can be complex and expensive. Further, copper-silver ionization involves positively charged ions of these metals lysing cell walls of *Legionella*, but this is slower than other methods with lower efficiency and reliability. Another conventional process involves filtration with significant maintenance that can be expensive to implement. Another conventional approach includes a combination of these techniques. Even though these conventional processes have been used, Legionnaires disease persists, and a need to eliminate *Legionella* in water persists for which Water treatment system 200 and processes described herein provide.

Water treatment system 200 and treating water for abating bacterial growth provide a water heating system that can be part of a building plumbing system. Water heating systems can include a storage tank with a heat source, and, as water is routed through the tank, the water is heated and then dispensed into the building piping network to deliver hot water throughout the building, but conventional systems can maintain or grow pathogenic bacteria, which water treatment system 200 and treating water for abating bacterial growth overcomes.

Legionnaires' disease is a form of pneumonia transmitted by inhaling *Legionella pneumophila*, a bacteria that is present in water sources, and under certain conditions can form colonies and multiply, which increases exposure risk. Conditions at which *Legionella pneumophila* thrives can be present in conventional hot water plumbing distribution networks of buildings. Conventional reduction of exposure to *Legionella* can be complicated, expensive, and ineffective as indicated by the increasing infection rates. Water treatment system 200 and treating water for abating bacterial growth overcomes these limitations of conventional technology.

Handling *Legionella* in plumbing systems has involved managing temperatures within the hot water side of the conventional water heating system and piping network to maintain water temperatures above those at which colonies will grow, approximately 49° C. This conventional approach is deficient because people can be injured if they are exposed to water that is too hot so that municipal code regulations do not allow water in piping networks to be hotter than this temperature. While this conventional approach can minimize growth of colonies, it does not eliminate risk and can be complicated to implement. The temperature at which to maintain hot water in the conventional system has been debated by epidemiologists, health and safety professionals, and engineers.

Beneficially, Water treatment system 200 can include a water heater with a liquid-to-liquid, unmixed heat exchanger connected to the inlet and outlet of the hot water storage tank. By connecting the heat exchanger in this manner, temperature (e.g., greater than 71° C.) within the storage tank is hot enough to kill all of the live bacteria before it enters piping network, e.g., in user 215. Fluid-isolated heat exchanger 204 recovers energy from the ultra-hot container heated water 206 that leaves water treatment container 203, cooling to a safe distribution temperature, i.e., less than or equal to safe delivery temperature TS. The energy is used to preheat input cold water 205 before entering as to conserve energy. Further beneficially, water treatment system 200 and treating water for abating bacterial growth communicates flowing into user 215 hot water distribution system through a single point that is maintained at a temperature so high that bacteria cannot survive and eliminates risk of exposure to building occupants, to achieve energy conservation, and reduced risk of scalding.

While one or more embodiments have been shown and described, modifications and substitutions may be made thereto without departing from the spirit and scope of the invention. Accordingly, it is to be understood that the present invention has been described by way of illustrations and not limitation. Embodiments herein can be used independently or can be combined.

All ranges disclosed herein are inclusive of the endpoints, and the endpoints are independently combinable with each other. The ranges are continuous and thus contain every value and subset thereof in the range. Unless otherwise stated or contextually inapplicable, all percentages, when expressing a quantity, are weight percentages. The suffix "(s)" as used herein is intended to include both the singular and the plural of the term that it modifies, thereby including at least one of that term (e.g., the colorant(s) includes at least one colorants). "Optional" or "optionally" means that the subsequently described event or circumstance can or cannot occur, and that the description includes instances where the event occurs and instances where it does not. As used herein, "combination" is inclusive of blends, mixtures, alloys, reaction products, and the like.

As used herein, "a combination thereof" refers to a combination comprising at least one of the named constituents, components, compounds, or elements, optionally together with one or more of the same class of constituents, components, compounds, or elements.

All references are incorporated herein by reference.

The use of the terms "a" and "an" and "the" and similar referents in the context of describing the invention (especially in the context of the following claims) are to be construed to cover both the singular and the plural, unless otherwise indicated herein or clearly contradicted by context. "Or" means "and/or." It should further be noted that the terms "first," "second," "primary," "secondary," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity). The conjunction "or" is used to link objects of a list or alternatives and is not disjunctive; rather the elements can be used separately or can be combined together under appropriate circumstances.

What is claimed is:

1. A water treatment system for treating water to abate bacterial growth and comprising: a cold water supply conduit that receives input cold water and communicates the input cold water to a water treatment container; the water treatment container in thermal communication with a heater and that: receives the input cold water at cold water temperature TC, receives main heat from the heater, increases cold water temperature TC of the input cold water by the main heat from the heater, produces container heated water at high water temperature TH from the input cold water by increasing cold water temperature TC to high water temperature TH, and communicates the container heated water, such that high water temperature TH is greater than or equal to kill temperature TK for bacteria to kill bacteria in the container heated water, and such that the container heated water does not contain viable bacteria; a hot water delivery conduit comprising a transitional cooling zone and a delivery zone in fluid communication with the transitional cooling zone, such that the transitional cooling zone is arranged along the hot water delivery conduit; the transitional cooling zone in thermal communication with a fluid-isolated heat exchanger, such that the transitional cooling zone: receives the container heated water from the water treatment container, transfers thermal energy from the container heated water to the fluid-isolated heat exchanger while maintaining hydraulic isolation preventing mass transfer of the container heated water into the fluid-isolated heat exchanger, decreases high water temperature TH of the container heated water by transfer of second heat from the container heated water to the fluid-isolated heat exchanger in an absence of fluid communication between the hot water delivery conduit and the fluid-isolated heat exchanger, produces transitionally cooled water at hot water delivery temperature TD from the container heated water by decreasing high water temperature TH to hot water delivery temperature TD, and communicates the transitionally cooled water as delivery hot water to the delivery zone; and the fluid-isolated heat exchanger in thermal communication with the transitional cooling zone and that: provides heat flow from the transitional cooling zone while maintaining fluid isolation between the transitional cooling zone and the cold water conduit, such that the transitional cooling zone does not contain viable bacteria from the water treatment container or the cold water supply conduit, wherein the fluid-isolated heat exchanger contacts the transitional cooling zone of the hot water delivery conduit but is physically separated from and devoid of contact with the cold water supply conduit.

2. The water treatment system of claim 1, further comprising a flow controller in fluid communication with the transitional cooling zone and that prevents delivery hot water from flowing unless a temperature of the delivery hot water is less than or equal to a safe delivery temperature TS.

3. The water treatment system of claim 2, wherein the safe delivery temperature TS is less than 49° C.

4. The water treatment system of claim 3, wherein the pathogenic bacteria comprises *Legionella* bacteria.

5. The water treatment system of claim 1, wherein the bacteria comprises pathogenic bacteria.

6. The water treatment system of claim 1, wherein the water treatment container comprises a tankless water heater.

7. The water treatment system of claim 1, wherein the cold water temperature TC is for liquid water from greater than 0° C. to 16° C.

8. The water treatment system of claim 1, wherein the high water temperature TH is greater than or equal to a kill temperature TK for bacteria.

* * * * *